US005465197A

United States Patent [19]

Chien

[11] Patent Number: 5,465,197

[45] Date of Patent: Nov. 7, 1995

[54] PORTABLE LIGHT

[76] Inventor: Tseng-Lu Chien, 8th Fl.-6, No. 9, Sanmin Rd., Taipei, Taiwan

[21] Appl. No.: 255,923

[22] Filed: Jun. 7, 1994

[51] Int. Cl.[6] ..... A43B 23/00; F21L 15/08

[52] U.S. Cl. ..... 362/203; 362/394; 362/276; 362/802; 36/137; 200/61.51; 200/61.52

[58] Field of Search ..... 362/394, 103, 362/800, 802, 276; 200/61.51, 61.52, 61.49, 61.48; 36/137; 273/58 G

[56] References Cited

U.S. PATENT DOCUMENTS

| | | | |
|---|---|---|---|
| 2,572,760 | 10/1951 | Rikelman | 36/137 X |
| 2,634,407 | 4/1953 | Johnson | 200/61.49 |
| 2,849,819 | 9/1958 | Murphy et al. | 273/58 G |
| 2,959,892 | 11/1960 | Johnson | 200/61.49 |
| 3,053,949 | 9/1962 | Johnson | 200/61.49 |
| 3,502,831 | 3/1970 | McRoskey | 200/61.49 |
| 4,158,922 | 6/1979 | Dana, III | 36/137 |
| 4,412,205 | 10/1983 | Von Kemenczky | 362/137 X |
| 4,595,200 | 6/1986 | Shishido | 273/58 G |
| 4,701,146 | 10/1987 | Swenson | 273/58 G |
| 4,848,009 | 7/1989 | Rodgers | 362/103 |
| 4,894,757 | 1/1990 | Frusha et al. | 362/103 X |
| 5,080,362 | 1/1992 | Lillard | 200/61.51 |
| 5,343,190 | 8/1994 | Rodgers | 362/103 X |
| 5,406,724 | 4/1995 | Lin | 362/103 X |

*Primary Examiner*—Ira S. Lazarus
*Assistant Examiner*—Thomas M. Sember
*Attorney, Agent, or Firm*—Bacon & Thomas

[57] ABSTRACT

A portable light includes a shell which defines an opening. The shell is linked to a lens so as to cover the opening therein. A printed circuit board (PCB) is contained in the shell. The PCB is operatively connected with a light emitting diode (LED) for flashing and a vibration-sensitive switch for controlling the LED. The PCB is operatively connected with a metal strip. A dry battery is disposed between the PCB and the metal strip. The shell can be linked to a buckle for attaching the portable light to a shoe.

10 Claims, 5 Drawing Sheets

PORTABLE LIGHT

BACKGROUND OF THE INVENTION

The present invention relates to a portable light.

At present, street activities such as skateboarding, roller-skating, street basketball etc. are very popular with city kids as special and safe areas are often not provided. During those activities, when visibility is poor due to it being night-time or foggy, those city kids are exposed to great danger from moving vehicles. Although flashlights have long been available, they are heavy, cumbersome, not easily attached to a wearer and project a light that is not eye-catching. Thus, there has been a long and unfulfilled need for a light source that is not heavy, is easily attached to a wearer's article of clothing, such as a shoe and projects an eye-catching light.

SUMMARY OF THE INVENTION

It is the primary object of the present invention to provide an active warning device for people who are on the streets when it is dark or visibility is poor.

The primary object of the present invention is achieved by providing a portable light. The portable light includes a shell which defines an opening. The shell is linked to a lens so as to cover the opening therein. A printed circuit board (PCB) is contained in the shell. The PCB is operatively connected with a light emitting diode (LED) for flashing and a motion-sensitive switch for controlling the LED. The PCB is operatively connected with a metal strip. A dry battery is disposed between the PCB and the metal strip. The shell can be linked to a buckle for attaching the portable light to a shoe.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
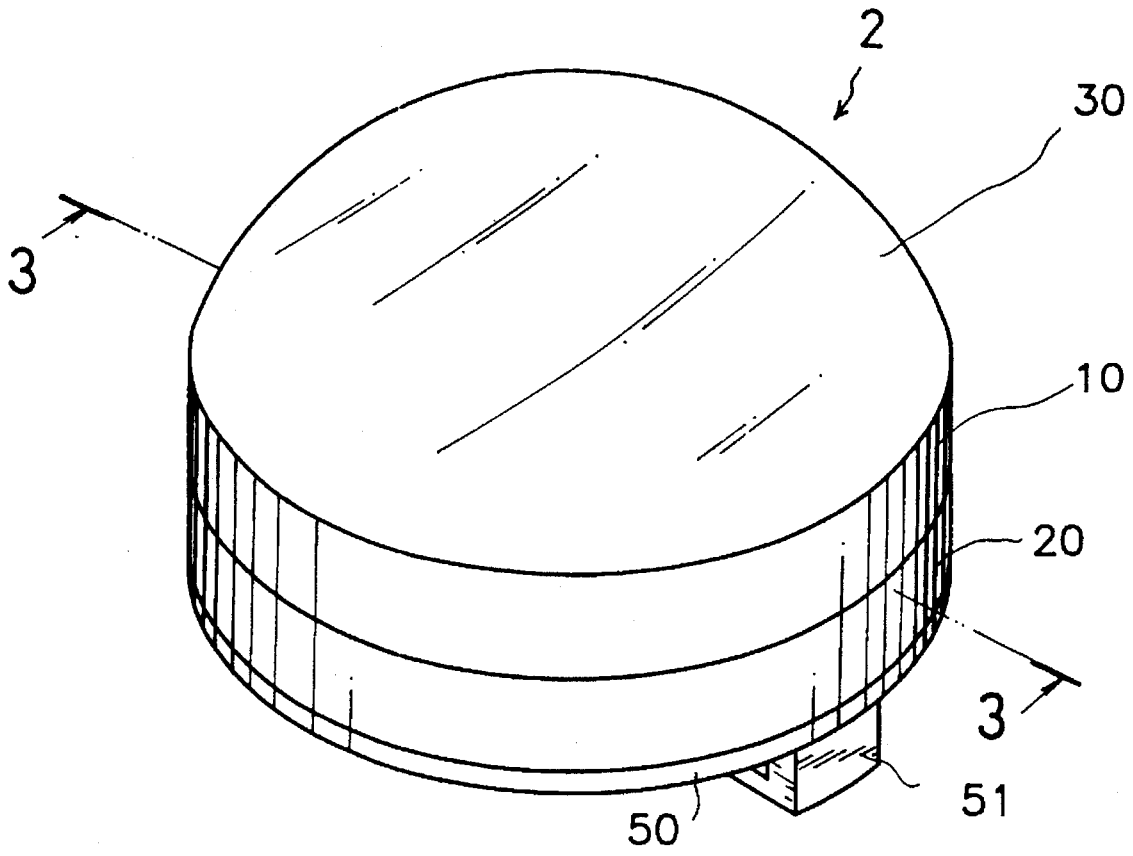
FIG. 1 is a perspective view of a portable light in accordance with the present invention.
Figure 2:
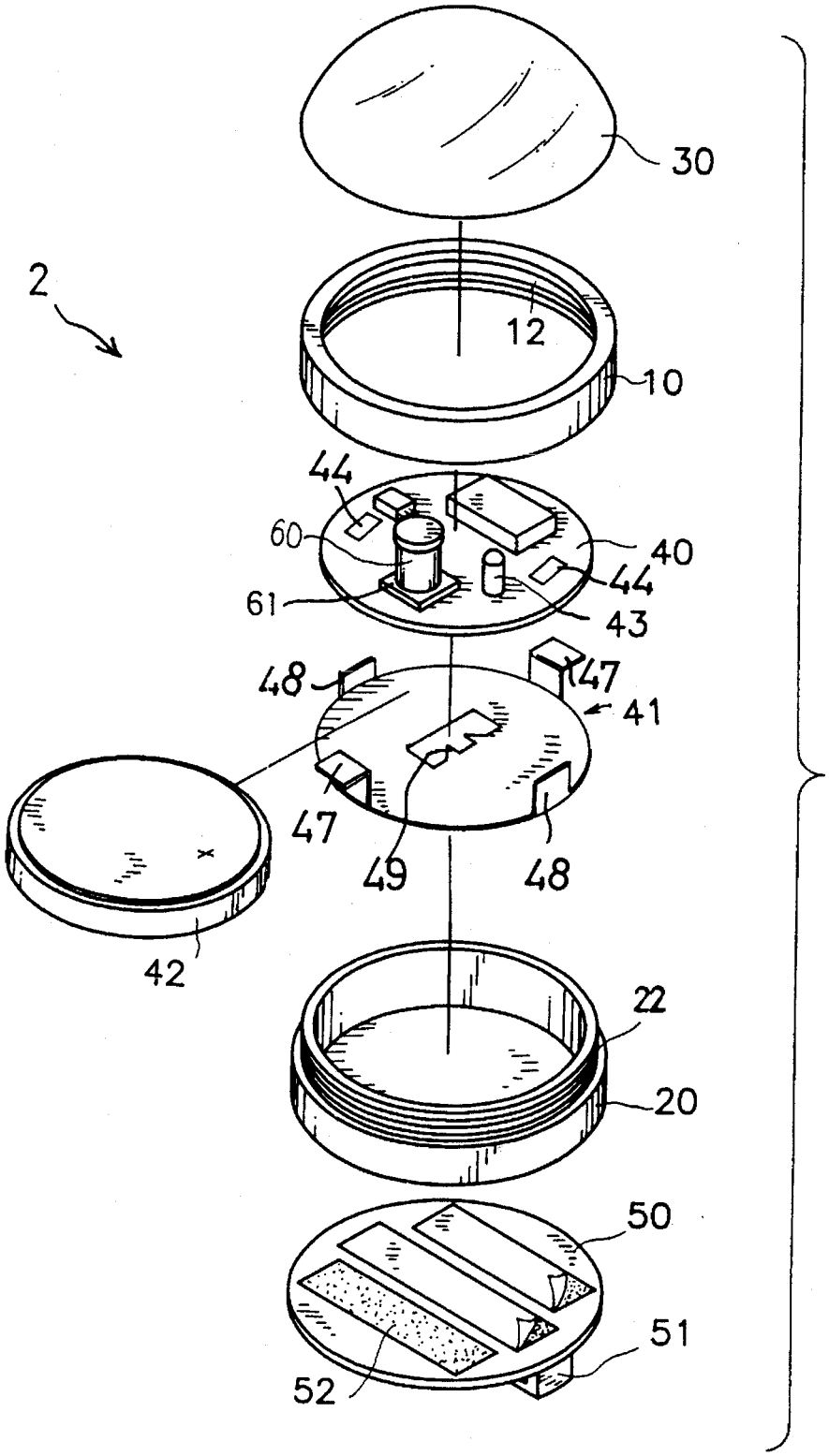
FIG. 2 is an exploded view of the portable light as shown in FIG. 1.

Referring to FIG. 1, a portable light 2 includes a shell in order to contain a plurality of components (see FIG. 2). The shell includes an upper half-shell 10 and a lower half-shell 20 which is threadably engaged with the upper half-shell 10. A lens 30 is adhered to the upper half-shell 10. The lower half-shell 20 is adhered to a buckle 50 in order to be engaged with a shoe lace 71 of a sports shoe 70 (see FIG. 6).

Referring to FIG. 2, the upper half-shell 10 includes an annular plate and a wall which is formed about the annular plate. The annular plate of the upper half-shell 10 defines an opening (not numbered). The wall of the upper half-shell 10 defines an internal surface and an external surface. A thread 12 is formed on the internal surface of the wall of the upper half-shell 10. The lower half-shell 20 includes a disk and a wall which is formed about the disk. The wall of the lower half-shell 20 defines an internal surface and an external surface. A thread 22 is formed on the external surface of the wall of the lower half-shell 20. The threads 12 and 22 are engageable with each other in order to join the upper half-shell 10 with the lower half-shell 20.

The lens 30 is a semi-spherical member which includes a rim. The rim of the lens 30 is adhered to the annular plate of the upper half-shell 10. The opening in the upper half-shell 10 is sheltered by the lens 30.

Figure 3:
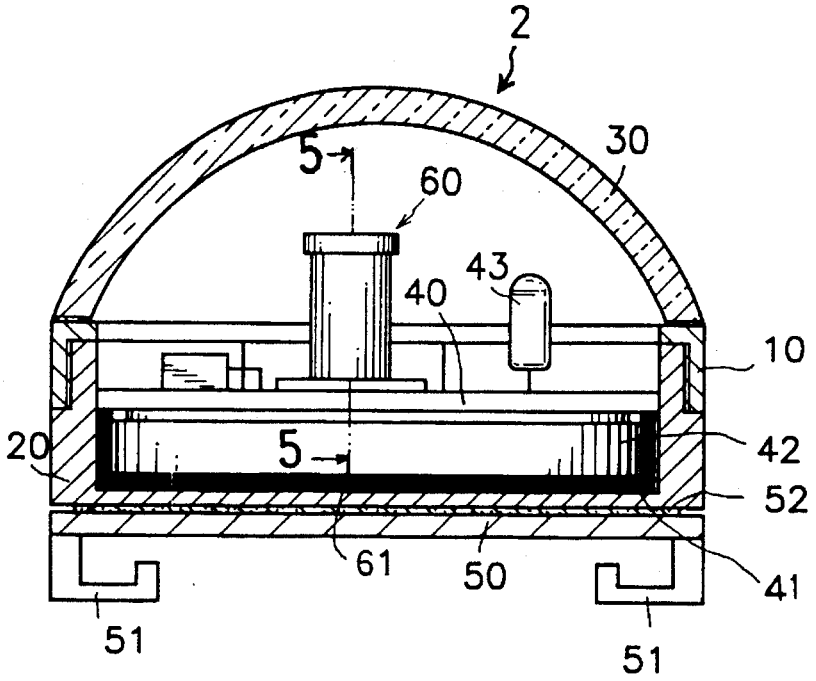
FIG. 3 is a cross-sectional view taken along a line 3—3 in FIG. 1.
Figure 5:
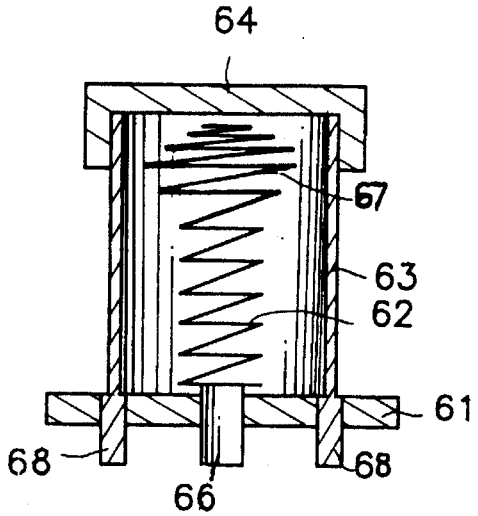
FIG. 5 is an enlarged cross-sectional view taken along a line 5—5 in FIG. 3.

The buckle 50 includes a disk and two claws 51 (see FIG. 3). The disk of the buckle 50 defines an upperside and an underside. The claws 51 are formed on the underside of the disk of the buckle 50. A few pieces of double-sided tape 52 are provided between the underside of the disk of the lower half-shell 20 and the upperside of the disk of the buckle 50 in order to attach the lower half-shell 20 to the buckle 50.

Alternatively, a Velcro tape can be provided between the underside of the disk of the lower half-shell 20 and the upperside of the disk of the buckle 50 in order to attach the lower half-shell 20 to the buckle 50.

The portable light can be attached to a shoe by a Velcro tape means.

The components include a printed circuit board (PCB) 40 which defines two slots 44. A contact (not shown) is formed on the PCB 40 in the form of a solder point. A light emitting diode (LED) 43 is operatively connected with the PCB 40. A motion-sensitive switch 60 is operatively connected with the PCB 40. An insulator 61 is disposed between the PCB 40 and the motion-sensitive switch 60. There is a metal strip 41 from which two engaging tabs 47 and two retaining tabs 48 project. The engaging tabs 47 are inserted through the slots 44, and are bent in order to grip the PCB 40. A press-out 49 is formed at the center of the metal strip 41. One of the engaging tabs 47, the LED 43 and the contact are connected with one another by means of the PCB 40. A dry battery 42 is retained between PCB 40 and the metal strip 41 by means of the engaging tabs 47 and the retaining tabs 48. The contact 45 contacts an electrode of the dry battery 42, and the press-out 49 abuts against an opposite electrode of the dry battery 42. The above-mentioned components thus form a circuit.

Figure 4:
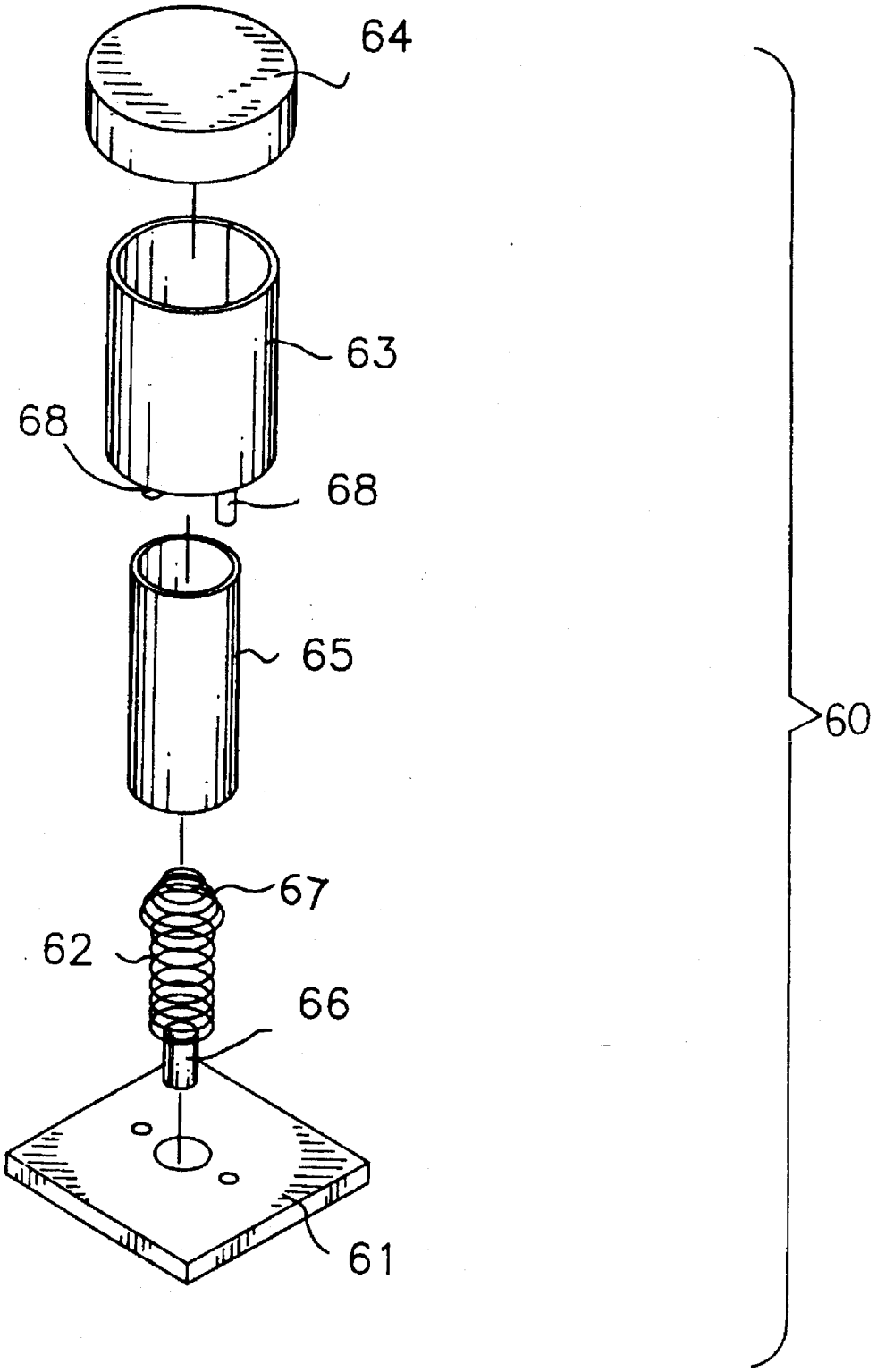
FIG. 4 is an exploded view of a vibration-sensitive switch used in the portable light as shown in FIG. 1.

FIG. 3 is an exploded perspective view which more clearly illustrates how the light emitting diode 43 and the motion-sensitive switch 60 are mounted on a first side of the circuit board 40, and the dry battery 42 is sandwiched between the second side of the circuit board 40 and the metal strip 41, such that the metal strip retains the battery and electrically connects one of the electrodes thereof to the circuit board, with the other electrode of the battery being directly connected to the circuit board to complete the power circuit for the LED Referring to FIG. 4, the motion-sensitive switch 60 includes a spring 62 and a metal cylinder 63. The spring 62 includes a foot 66 and an enlarged head 67. The foot 66 is operatively connected with a first contact of the PCB 40. The metal cylinder 63 includes two feet 68 which are attached to a second contact of the PCB 40. The LED 43 is electrically connected to the dry battery 42 when the first contact of the PCB 40 is electrically connected to the second contact of the PCB 40. As the motion-sensitive switch 60 is subjected to motion, the spring 62 oscillates so as to periodically contact the metal cylinder, meanwhile the first contact of the PCB 40 is periodically connected to the second contact of the PCB 40 via the sensitive switch 60 and the LED 43 flashes. The head 67 makes the spring 62 more sensitive to motion. A cap 64 is mounted on the metal cylinder 63 in order to protect the spring 62. In storage of the portable light, an insulator sleeve 65 can be disposed between the spring 62 and the metal cylinder 63 to prevent the spring 62 from contacting the metal cylinder 63. Thus, the LED 43 does not flash so as to save electricity when the portable light is not in use especially when in delivery.

Figure 6:
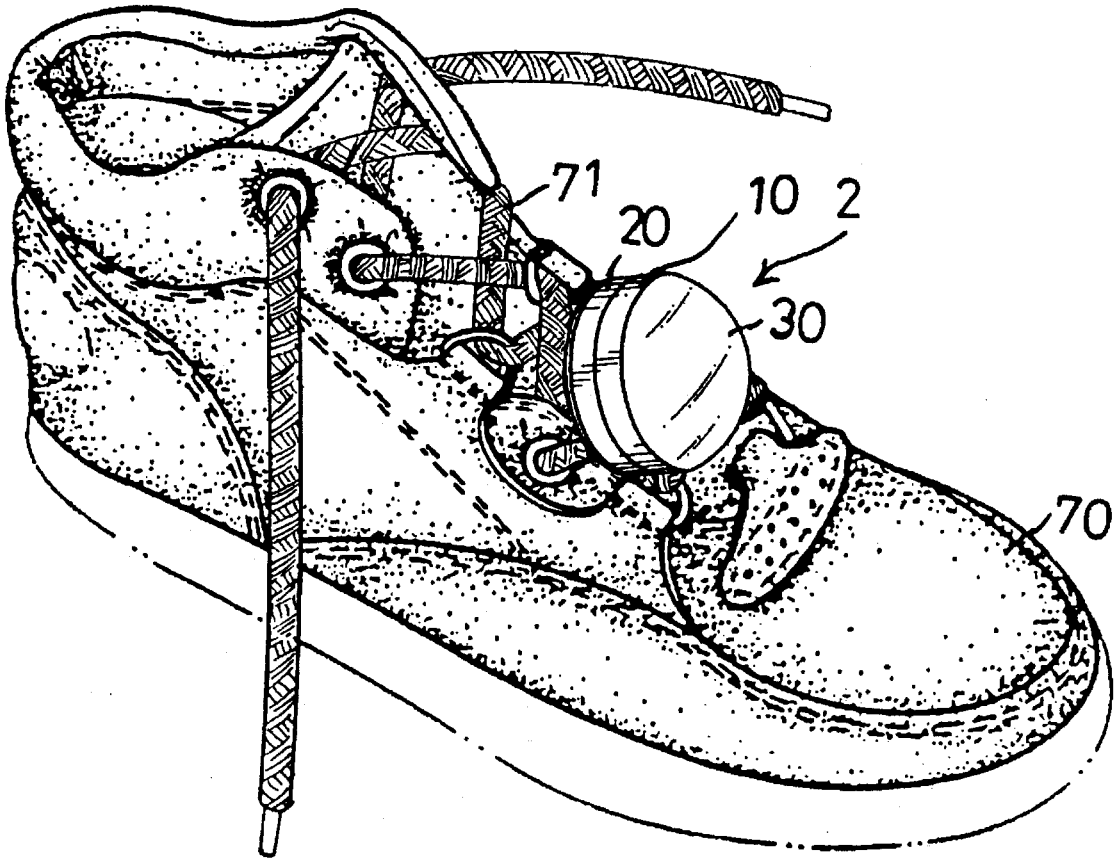
FIG. 6 is a perspective view of a sports shoe to which the portable light is attached.

Referring to FIG. 6, the portable light 2 is attached to the sports shoe 70 by inserting the shoe lace 71 through the claws 51 of the buckle 50.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A portable light comprising a shell which defines an opening, a lens which is mounted on the shell so as to cover the opening, a printed circuit board having first and second sides and which is positioned in the shell, a light emitting diode which is operatively connected with and mounted on the first side of the printed circuit board, a motion-sensitive switch which is operatively connected with and mounted on the first side of the printed circuit board, and a metal strip which is operatively connected with the printed circuit board, a dry battery, wherein the, dry battery is sandwiched between the second side of the printed circuit board and the metal strip, whereby the metal strip connects one side of the battery with the circuit board and at the same time retains the dry battery against the circuit board so that the opposite electrode of the dry battery directly engages the circuit board.

2. A portable light in accordance with claim 1 wherein the motion-sensitive switch comprises a metal cylinder which is operatively connected with a first contact of the printed circuit board and a spring which is operatively connected with a second contact of the printed circuit board, and the spring is disposed in the metal cylinder, whereby the light emitting diode is electrically connected to the dry battery when the first contact is electrically connected to the second contact, and whereby the spring periodically contacts the metal cylinder thus causing the light emitting diode to be periodically and electrically connected to the dry battery and to flash when the motion-sensitive switch is subjected to motion.

3. A portable light in accordance with claim 2 wherein the spring comprises an enlarged head for increasing motion sensitivity of the motion-sensitive switch.

4. A portable light in accordance with claim 1 comprising a buckle which is attached to the shell for releasably fastening to a shoe lace of a shoe.

5. A portable light in accordance with claim 2 comprising a cap which is mounted on the metal cylinder for protecting the spring.

6. A portable light in accordance with claim 2 further comprising an insulator sleeve which can be) is removably disposed between the spring and the metal cylinder in order to prevent the spring from contacting the metal cylinder so as to restrain the light emitting diode from flashing in order to save electricity when the portable light is not in use.

7. A portable light comprising a shell which defines an opening, a lens which is mounted on the shell so as to cover the opening, a printed circuit board positioned in the shell and having two sides, a light emitting diode which is operatively connected with and mounted on the first side of the printed circuit board, a motion sensitive switch is operatively connected with and mounted on the first side of the printed circuit board, a metal strip which is operatively connected with the printed circuit board, and a dry battery, wherein the dry battery is sandwiched between the second side of the printed circuit board and the metal strip, whereby the metal strip connects one side of the battery with the circuit board and at the same time retains the dry battery against the circuit board so that the opposite electrode of the dry battery directly engages the circuit board, and wherein the motion-sensitive switch comprises a metal cylinder which is operatively connected with a first contact of the printed circuit board and a spring which is operatively connected with a second contact of the printed circuit board, the spring being disposed in the metal cylinder, whereby the light emitting diode is electrically connected to the dry battery when the first contact is electrically connected to the second contact, and wherein the spring periodically contacts the metal cylinder, thus causing the light emitting diode to be periodically and electrically connected to the dry battery and to flash when the motion-sensitive is subjected to motion, and further comprising an insulator sleeve which is removably disposed between the spring and the metal cylinder in order to prevent the spring from contacting the metal cylinder so as to thereby prevent the light emitting diode from flashing in order to save electricity when the portable light is not in use.

8. A portable light in accordance with claim 7 wherein the spring comprises an enlarged head for increasing motion sensitivity of the motion-sensitive switch.

9. A portable light in accordance with claim 7 comprising a buckle which is attached to the shell for releasably fastening the portable light to a shoe lace of a shoe.

10. A portable light in accordance with claim 7 comprising a cap which is mounted on the metal cylinder for protecting the spring.

* * * * *